United States Patent [19]

Chalmers et al.

[11] 4,195,455

[45] Apr. 1, 1980

[54] ADJUSTABLE SOFFIT SYSTEM

[75] Inventors: Alexander A. Chalmers, Warren; J. Lynn Gailey, Newton Falls, both of Ohio

[73] Assignee: Alcan Aluminum Corporation, Cleveland, Ohio

[21] Appl. No.: 906,874

[22] Filed: May 17, 1978

[51] Int. Cl.[2] ..... E04B 7/00

[52] U.S. Cl. ..... 52/94; 52/763

[58] Field of Search ..... 52/94, 96, 478, 763, 52/668, 669, 762, 779, 780, 74, 75

[56] References Cited

U.S. PATENT DOCUMENTS

| | | | |
|---|---|---|---|
| 2,648,105 | 8/1953 | Kurtz | 52/75 |
| 3,204,374 | 9/1965 | Hellekson | 52/94 |
| 3,412,516 | 11/1968 | Lindström | 52/762 |
| 3,824,749 | 7/1974 | Scherf | 52/94 X |
| 4,114,338 | 9/1978 | Beck | 52/478 |

*Primary Examiner*—Carl D. Friedman

*Attorney, Agent, or Firm*—Copper, Dunham, Clark, Griffin & Moran

[57] ABSTRACT

A soffit system includes a plurality of panels of individually adjustable length, in a side-by-side nested array supported on at least two spaced-apart stringer members. Each adjustable panel has at least two similar components, an end portion of one being inserted in an end portion of the other so that the two components overlap. Each component has a horizontal web and two parallel side flanges with conformingly curved profiles opening in the same direction, i.e. one flange being externally concave and the opposite externally convex. The side flanges of the overlapped components snap fit together to interlock their overlapping end portions, thus providing the adjustable-length feature. The side flanges of each panel component snap fit into inversely contoured notches formed in a stringer member, thus to resiliently engage the stringer member providing support; in the mounted array, the sides of adjacent panels are nested together by the mating interfit of each contoured flange with the inverse contour of the flange on the next immediately adjacent adjustable panel.

11 Claims, 9 Drawing Figures

Fig. 3.
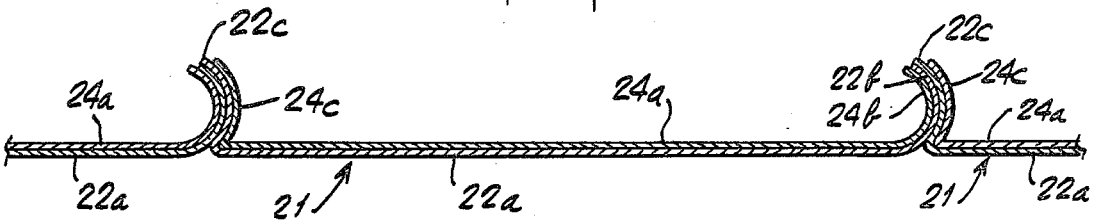
Fig. 4.
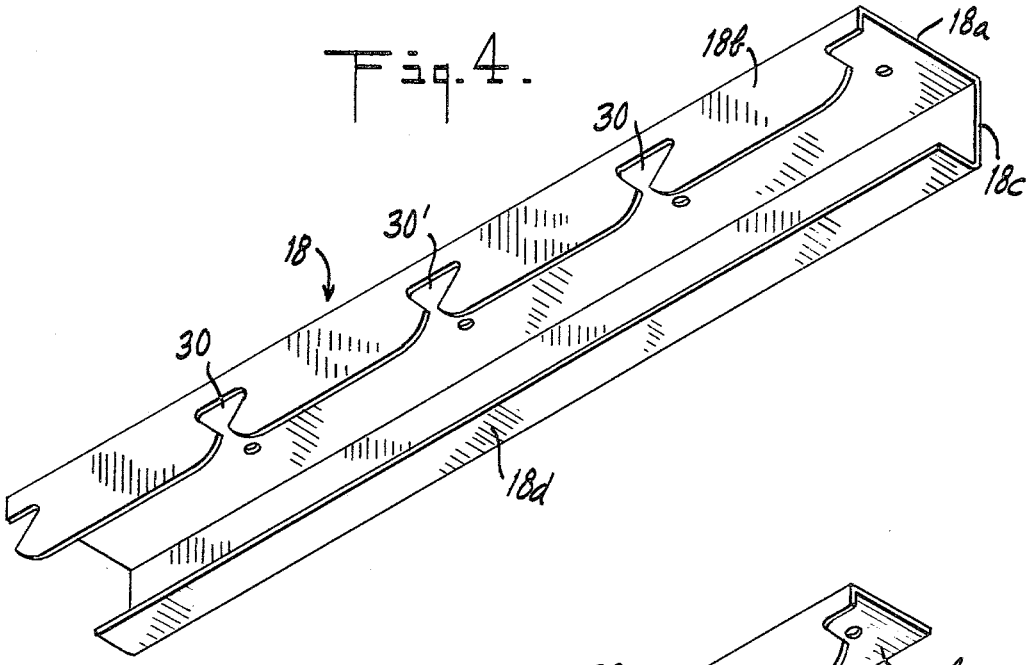
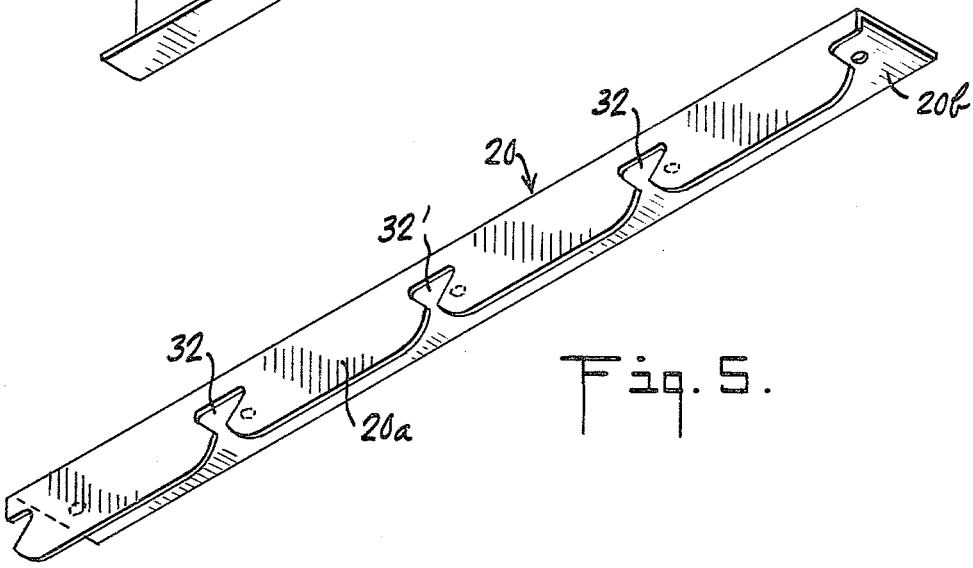
Fig. 5.

30c
30b
30e
30a
30d
24b
24a
24c
30
22b
21
30'
18b
22a
22c
18
18a
18c
20
20a
20b
22
24
38
38b

ADJUSTABLE SOFFIT SYSTEM

BACKGROUND OF THE INVENTION

This invention relates to soffits, such as are installed beneath eaves or under other roof portions of buildings, and more particularly to soffit systems that are adjustable in width to accommodate a range of differing dimensional requirements. In a specific sense, the invention is directed to new and improved metal panel soffit systems.

Soffits constituted of roll-formed sheet metal panels have heretofore been employed, for example, to close the gap or space between an exterior building wall and an eave overhanging the wall. Such soffits are used for aesthetic and/or protective purposes. A particularly important criterion of metal panel soffit design is that the soffit be able to withstand wind and other forces without dislodgment of the panels or opening of the joints between panels.

In one illustrative known type of metal panel soffit, the panels extend from the wall to the outer edge or fascia board of the eave; typically, each panel has an S-lock formed on one side and a mating leg on the other, so that the sides of adjacent panels fit together. The ends of the panels facing the wall are fitted into a panel-receiving groove or trough in a horizontally elongated, roll-formed metal trim section fastened to the upper portion of the wall beneath the eave, while the opposite ends of the panels (beneath the eave edge) are individually face-nailed to the bottom of the fascia board. Ordinarily, the soffit panels are furnished in extended lengths, which must be cut into shorter pieces each equal in length to the distance from the wall to the fascia board.

Conventional soffits of the type described have several disadvantages. Each cut panel must be individually aligned in proper perpendicular relation to the wall as it is installed, and each must be separately nailed to the fascia board; these operations are inconvenient and time-consuming, presenting difficulty for inexperienced installers. The requirement that each panel be cut to size for a particular installation is especially troublesome, yet owing to variations in the extent of overhang of different eaves (and also owing to the fact that in some instances eaves depart from true parallelism with adjacent walls), it is not practicable for panel suppliers to attempt to provide panels that are precut to proper dimensions. The installation of other known types of metal panel soffits likewise requires cutting of the panels to size on the job.

Ceiling and awning assemblies are also known in which a parallel array of roll-formed sheet metal panels, each having opposed longitudinal flanges curved or bent toward each other, are snap-fitted over projections on elongated metal stringers extending transversely of the panels. These assemblies have sometimes been used in soffit-like applications; but again, it is necessary to cut individual panels to size for a specific job.

Thus, although there is a growing market for "do-it-yourself" home improvement kits or systems enabling easy installation of trim and other house features by relatively untrained homeowners lacking special tools, existing soffit systems are not capable of adaptation to meet this demand, owing in particular to the necessity of cutting formed metal panels to size on the job, with the attendant risks of leaving dangerous sharp edges and/or deforming the panels, as well as to the other disadvantages mentioned above. It will be appreciated that the cutting of metal panels having formed flanges or sides without deforming them is at best a difficult task, even apart from the problems of ensuring that their ends are acceptably square and that their lengths are correct and adequately uniform.

SUMMARY OF THE INVENTION

The present invention broadly contemplates the provision of a soffit system comprising a plurality of panels of individually adjustable length disposed in side-by-side parallel array, and means for supporting the array of panels. In this system, each of the panels comprises at least first and second panel components arranged in tandem with one end portion of one of the two components inserted within one end portion of the other such that the last-mentioned end portions of the first and second components overlap, the extent of overlap thereof being adjustable for adjusting the length of the panel; and the first and second components have interengageable means for securing their last-mentioned end portions together throughout a range of extents of overlap of the first and second components corresponding to a range of lengths of the panel they comprise.

Each panel, therefore, is capable of being varied in length over a substantial range by adjusting the amount of overlap of its components, so that precut individual components of uniform length may be assembled to achieve any desired overall panel length within that range. Consequently, for an under-eave soffit wherein the panels each extend to the eave edge from the exterior building wall beneath the eave, an advantageously broad range of different soffit widths (the soffit width being the wall-to-eave dimension, i.e. equal to the length of each panel) may be provided with a single kit or system made up of the same uniform-length individual panel components, without requiring any cutting of panels by the installer. In other words, in place of the fixed-length panels of prior soffits, which must necessarily be cut on the job to meet the differing dimensional requirements of a particular installation, the system of the present invention provides panels of adjustable length so as to obviate such cutting to size, yet these panels are constituted of overlapped components of individually fixed and uniform length which may practicably be produced and sold as precut components in kits.

As a particular feature of the invention, each of the panel components is made of resiliently deformable sheet material and has a horizontal web with opposite sides bent upwardly to form two parallel longitudinal flanges both having conformingly curved profiles oriented in the same direction such that one of the two flanges is externally convex and the other is externally concave. The first and second components of each panel have the same orientation, when assembled with one end portion of one of them inserted in one end portion of the other, and the flanges of the inserted end portion of the one component are nestingly gripped between the flanges of the overlapping end portion of the other component for securing their last-mentioned end portions together; i.e. the flanges constitute the interengaging means of the two components.

Still more particularly, in accordance with the invention, the first and second components of each panel have substantially identical cross-sectional dimensions, while the flanges of the first and second components all have substantially identical radii of cross-sectional curvature, such that one end portion of either of the components is snap-fittingly insertable into one end portion of the other. Thus, stated with reference to a panel constituted of two components, the flanges of the two components snap-fit together in the region in which one overlaps the other, to interlock grippingly and nestingly. In particular, the externally convex ones of the flanges of each component are so shaped as to accommodate insertion, into the component, of a second component of identical shape, dimensions and orientation, and to provide closely conforming, gripping interengagement of the inserted and outer components while urging the web of the inserted component into conforming engagement with the web of the outer component. As thus interlocked, the flanges hold the two components securely joined against transverse displacement relative to each other, so that the panel is stable when supported, in the assembled soffit, only at its opposite ends. In addition, with all the components in the array of panels having the same orientation, the externally convex flanges of each panel are nestingly received in the externally concave flanges of the next adjacent panel in the assembled parallel array, to provide an interlocking engagement that inhibits transverse displacement of adjacent panels relative to each other, thereby further stabilizing the array.

A preferred flange configuration, especially for the externally convex flanges of the components (and also conveniently for the externally concave flanges) to provide the above-stated functions is a flange having, in profile, a generally C-shaped portion, and indeed very preferably a flange which in profile is a simple C shape of continuous curvature.

Also in accordance with the invention, with the first components of all the panels located at one end of the array (the term "ends of the array" being used herein to designate those extremities of the array at which the ends of the panels are located), the panel-supporting means comprises first mounting means extending transversely of the first components and snap-fittingly engageable by the flanges of the first components at a locality spaced from the second components. The supporting means further includes second mounting means for supporting the panels at a locality spaced from the first components; in presently preferred embodiments, this second mounting means, similarly, comprises means extending transversely of the second components and snap-fittingly engageable by the flanges of the second components. Thus, each of the first and second mounting means may be a horizontally elongated stringer member disposed above and extending transversely across the array of panels and having spaced along its length a plurality of downwardly opening notches, each dimensioned to receive two nested component flanges, such that the opposite longitudinal flanges of each component are snap-fittingly received in two notches of one of the stringers.

For example, in an under-eave installation two stringer members are respectively mounted, in parallel relation at a common elevation above the ground, on the edge of the eave and on the upper part of the exterior building wall beneath the eave. Advantageously, as a still further particular feature of the invention, at least one of these two stringer members may be a channel member with two spaced depending legs, the notches being formed in one of the legs and the other leg having its lower margin bent into a return flange for underlying and covering the ends of the panel components that are mounted in the stringer notches.

The panel components, and also the stringer members, may be roll-formed from sheet metal strip. All of the panel components may be integral, unitary sheet metal elements essentially identical to each other in all dimensions, including length. At least some of the panel components may have plural openings (e.g. perforations) formed in their webs, for ventilating the space enclosed by the soffit; the components having such openings may be alternated, in the array of panels, with components having solid or imperforate webs, to provide a pleasing design.

The described soffit system affords significant advantages, especially with respect to ease and rapidity of installation, because the individual components are simply snap-fitted together to provide panels (each panel being, in accordance with present preference, an overlapped pair of components) of desired length depending on the amount of overlap, and the components are also simply snap-fitted onto the stringers, which automatically position the panels in proper alignment to each other and to the supporting building. Thus, once the stringers are initially mounted on the building structure, assembly of the soffit is an expeditious succession of snap-fitting operations that requires no special tools and no measuring, cutting, aligning or nailing of panels. The system is therefore well suited to "do-it-yourself" installation by homeowners and (as already explained) is marketable in the form of a kit containing uniform-length precut panel components that can be assembled to provide a soffit meeting any of a range of width requirements. Moreover, since the individual panels are not nailed, they may readily be removed for repair, or for access to the space enclosed by the soffit; yet while in place, the panels are securely and stably held to each other and to the stringers.

Further features and advantages of the invention will be apparent from the detailed description hereinbelow set forth, together with the accompanying drawings.

BRIEF DESCRIPTION OF THE DRAWINGS

FIG. 3 is a sectional view taken along the line 3—3 of FIG. 1;

FIG. 4 is a perspective view of the trim stringer member of the system of FIG. 1;

FIG. 5 is a perspective view of the eave stringer member of the FIG. 1; system;

DETAILED DESCRIPTION

Figure 1:
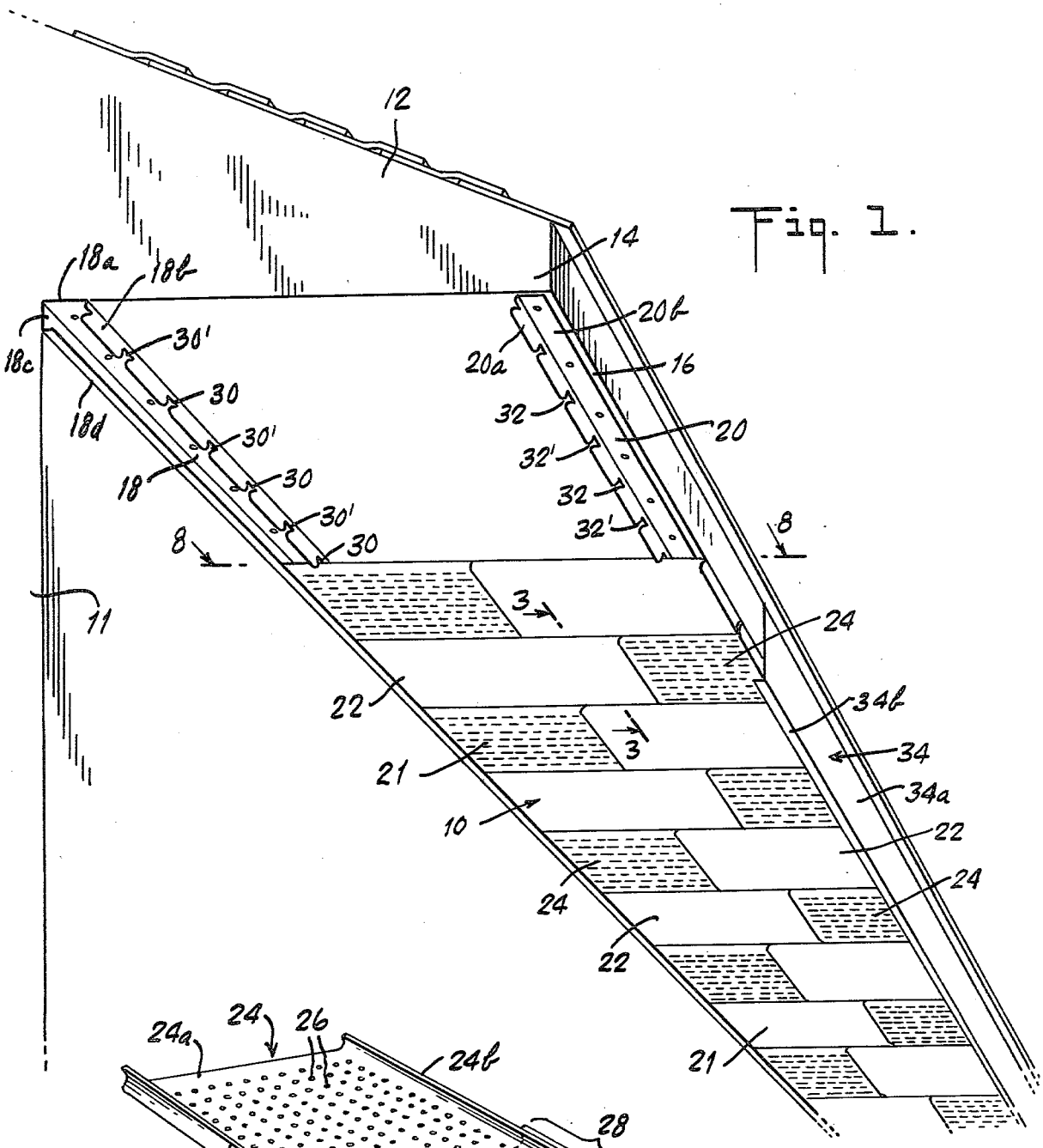
FIG. 1 is a perspective view, from below, of a soffit system embodying the present invention in a particular form, as installed on an overhanging eave of a building.

Referring first to FIG. 1, a soffit system 10 embodying the invention is shown as installed on the exterior of a building (e.g. of conventional frame construction) having a vertical exterior wall 11 and a sloping roof with an eave 12 that projects outwardly beyond the wall, in typical overhanging relation thereto. The outer edge 14 of the eave (on which a conventional fascia board 16 is mounted) is spaced outwardly from the wall 11 and extends horizontally, parallel to the plane of the wall, at an elevation below the upper extremity of the wall. As illustrated, the soffit 10 is installed in the usual location beneath the overhanging eave, to close the gap between the wall 11 and the eave edge 14.

The elements of the soffit system 10 are a horizontally elongated trim stringer member 18, a second horizontally elongated stringer member 20, and a plurality of panels 21 each constituted of two components respectively designated 22 and 24. When installed as shown in FIG. 1, the stringer members 18 and 20 are respectively mounted on the wall 11 and the eave edge 14 and extend therealong in parallel relation to each other at the same height above the ground. The components of each panel 21 are axially aligned (it being understood that terms such as "axis" and "axially" herein refer to the longitudinal geometric axis of a component); these panels extend horizontally between the stringer members 18 and 20 in side-by-side parallel array, perpendicularly to the stringers (and thus also perpendicularly to the wall 11) with a first component of each panel engaging and supported by the stringer member 18 at one end of the panel and the second component of each panel engaging and supported by the stringer member 20 at the other end of the panel, all as hereinafter further explained. In the illustrated installation, the opposite ends of the panels lie in parallel vertical planes, i.e. all the panel ends adjacent the wall 11 are aligned in a first vertical plane, and (the panels being all adjusted to be equal in length) all the panel ends adjacent the eave edge 14 are aligned in a second vertical plane parallel to the first plane; however, if the eave edge departs from true parallelism with the wall 11, the lengths of successive adjacent panels may be progressively increased or decreased (very easily, owing to the adjustability of panel length afforded by the present invention) to accommodate this divergence. Each of the stringer members, and each of the panel components, may be a unitary formed (e.g. roll-formed) piece of sheet metal such as sheet aluminum having all exposed surfaces prepainted, the term "aluminum" as used herein embracing aluminum metal and alloys thereof.

Figure 2:
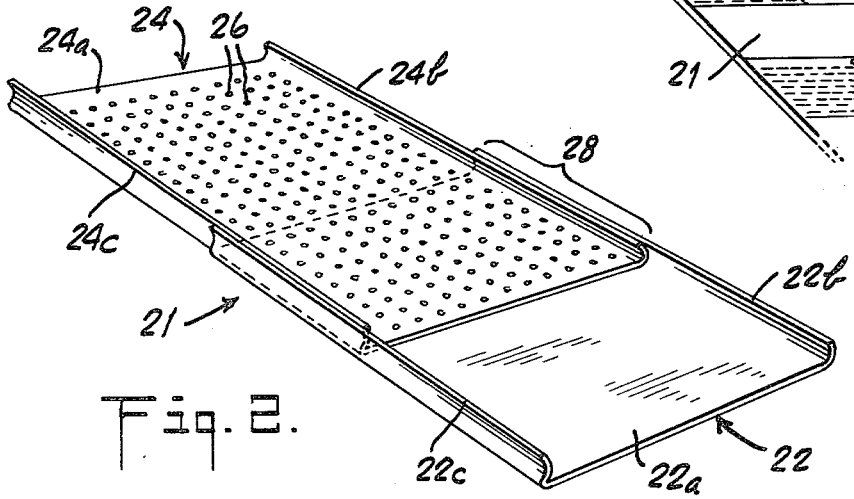
FIG. 2 is a perspective view, from above, of one panel of the system of FIG. 1.

More particularly, each of the panel components 22 and 24 is a unitary, integral roll-formed aluminum sheet panel of such gauge as to be self-sustaining in shape yet resiliently deformable. Each component 22, as best seen in FIGS. 2 and 3, has a broad, flat horizontal web 22*a* and opposite sides bent upwardly to form two parallel longitudinal flanges (i.e. flanges extending parallel to the component axis) respectively designated 22*b* and 22*c*, both having C-shaped profiles opening in the same direction, and with the same radius of curvature, such that one of the flanges (22*b*) is externally convex and the other (22*c*) is externally concave. The components 24 are essentially identical to the components 22 in configuration, and thus each component 24 has a central flat web 24*a* and longitudinal side flanges 24*b* and 24*c* which are respectively externally convex and externally concave; the webs 24*a* of the components 24, however, have a plurality of small openings such as perforations 26 for permitting ventilation of the space enclosed by the soffit beneath the eave 12, while the webs of the components 22 are solid, i.e. imperforate.

In the assembled soffit 10, the components 22 and 24 all have the downwardly facing surfaces of their webs lying substantially in the same horizontal plane, and all have the same orientation. That is to say, the flanges of all the components project upwardly, and the C-shaped profiles of the flanges of all the components all open in the same direction (to the left, as seen in FIG. 3); in addition, all the components are essentially identical to each other in all dimensions, viz. length, width, flange height, and radius of flange curvature. It will be understood, however, that directional terms such as "horizontal," "upward," etc., are used herein merely for convenience, to define the location of features of the soffit system and its elements relative to each other, as the system may be installed (for example) in situations where the orientation of the web surface plane of the panel components is other than horizontal.

As further shown in FIG. 2, in the assembled soffit the two components 22 and 24 of each panel 21 overlap, with an end portion of one of them (component 24, in FIG. 2) inserted in an end portion of the other (component 22, in FIG. 2), the flanges (24*b* and 24*c*) of the end portion of the inserted component (24) being nestingly gripped between the corresponding flanges (22*b* and 22*c*) of the end portion of the other component (22) of this panel. In other words, in the region 28 where the components overlap, the outer, convex surface of flange 24*b* fits snugly and conformingly against the inner concave surface of flange 22*b*, while the outer, concave surface of flange 24*c* fits snugly and conformingly against the inner, convex surface of flange 22*c*.

Since the two components are of identical dimensions, the insertion of the end portion of component 24 into the facing end portion of component 22 effects some measure of lateral deformation of the flanges in the region of overlap 28, in particular altering the circumferential length of the flanges 22*b* and 24*b* in the overlap region so that the overlap area appears to remain true in form as if the overlapped components were one continuous piece; and owing to the resiliency of the components, their overlapped flanges then grippingly engage. This interengagement of the C-shaped flanges holds the components securely and tightly together (e.g. under wind loads) against transverse separating movement (viz. movement in a vertical plane) relative to each other, and also against relative movement in an axial direction, even though in the assembled soffit the panel 21 is supported only at the opposite, non-overlapped ends of the components. Again owing to the resilient deformability of the components, the described overlap is achieved, during assembly of the soffit, by simply snap-fitting the end portion of the component 22 over the facing end portion of the component 24; it will be understood, of course, that as both components have the same dimensions, component 24 may equally well be snap-fitted over component 22, i.e. the relationship illustrated in FIG. 2 may be reversed.

Considered as a unit, then, each panel 21 constituted of a pair of components 22 and 24 has a central region 28 of overlap, with a non-overlapped portion of component 24 extending therefrom at one extremity and a non-overlapped portion of component 22 extending therefrom at the other extremity. It is the non-overlapped portions of the two components (respectively adjacent the two extremities of the panel) that respectively engage the two stringer members 18 and 20. The overall length of the panel 21 is equal to 2m−n, where m is the axial length of one component (the two components being equal to each other in length) and n is the axial length of the overlapping region 28; this overall length may be varied by altering the extent of overlapping, viz. by adjusting the relative positions of the components in an axial direction before they are initially snap-fitted together. The interengagement of the flanges of the two components, over a substantial range of values of overlap length n, provides a fully adequate and secure joint between the components so that the pair of components in effect constitutes a single, continuous, satisfactorily rigid panel of significantly variable length.

In the assembled array of panels, as best seen in FIG. 3, the externally convex flanges **22*b* and 24*b* of each panel 21 are nestingly received within the externally concave flanges 24*c* and 22*c* of the next adjacent panel 21; i.e. the convex external surfaces of flanges 22*b* and 24*b* of one panel fit snugly and conformingly within the concave external surfaces of the flanges 24*c* and 22*c*** of the next panel. This arrangement provides satisfactorily tight lateral joints between adjacent panels, as desired e.g. to prevent ingress of insects to the space enclosed by the soffit, and also inhibits relative movement of adjacent panels in directions transverse to the component web surfaces, thereby further stabilizing the panel array.

The use of perforate components 24 as well as imperforate components 22 in the soffit 10 not only provides ventilation for the soffit-enclosed space but, in addition, affords pleasing design effects. For example, as shown in FIG. 1, the components 22 and 24 may be alternated in successive panels 21, with the perforate component 24 of a first panel disposed toward the wall 11, the perforate component 24 of the next panel disposed away from the wall, etc.; and a wide variety of other design arrangements may be achieved using these two types of components together. Thus, as a further example, panels constituted of two components 22 may be alternated with panels constituted of two components 24 rather than having one component of each type in each panel.

The trim stringer member 18 (FIG. 4), mounted on the wall 11, is a downwardly opening channel member having a central web **18*a* and first and second spaced parallel depending legs respectively designated 18*b* and 18*c*. All the components 22 and 24 disposed at the end of the panel array facing toward wall 11 are mounted on this member. Along the length of the leg 18*b* are formed a plurality of regularly spaced notches 30 of identical size and shape opening through the lower margin of the leg, for snap-fittedly receiving and retaining the flanges of adjacent panel components of the array, each notch being shaped to receive the nested flanges (22*c* and 24*b*, or 24*c* and 22*b*, in FIGS. 6 and 7) of two adjacent components. Thus, each notch is defined by a continuous edge of the sheet metal leg 18*b*, lying in the vertical plane containing the leg, and has opposed edge portions 30*a* and 30*b* (FIG. 6) curving convexly upwardly (from the leg lower margin) toward each other, and then diverging sharply to provide facing points 30*c* and 30*d* and an enlarged open area 30*e*** above the points.

The spacing between notches is such that when the externally concave flange **22*c* of a component 22 is received in one of the notches 30 with its outer surface curving around the point 30*d* of that notch (the component 22 being axially perpendicular to the stringer member 18), the externally convex flange 22*b* of the same component snap-fits into another of the notches 30 with its inner surface curving around the point 30*d* of the latter notch; i.e. flange 22*b* can be snapped manually over that point 30*d* with minor lateral resilient deformation of the flange. This snap-fitting interengagement of the components with the stringer notches, resulting from the resilient deformability of the components, secures the components to the stringer member 18. As will be apparent from FIGS. 6 and 7, in the assembled soffit the point 30*d* of each flange-receiving notch directly engages the inner surface of the externally convex flange 22*b* or 24*b* received therein, and the outer surface of the externally concave flange 24*c* or 22*c* of the next adjacent component, received in the same notch, overlies that externally convex flange; the lower margin of the leg 18*b* between notches extends above the webs 22*a* and 24*a* of the components mounted in the notches. In the member 18 shown in the drawings, the leg 18*b* also has a second set of notches 30', identical to the notches 30 and respectively located at points halfway between adjacent notches 30, so that either the set of notches 30 or the set of notches 30'** can be used to mount the panels.

The second leg **18*c* of the trim stringer member 18 lies flat against the wall 11, beyond the ends of the components engaged by the stringer leg 18*b* (it being understood that the plane in which these component ends are aligned is intermediate the legs 18*b* and 18*c*), and has its lower extremity 18*d* bent into a return flange for underlying and thereby covering the last-mentioned component ends. Thus the member 18 serves both as a stringer (for supporting the ends of the panels adjacent wall 11) and as a trim member (for closing any gap between the panel ends and the wall and providing a finished appearance at the junction of the soffit with the wall). The return flange 8*d*, which lies in a horizontal plane, is narrower than the web 18*a* and therefore extends only part of the way across the space between the two legs 18*b* and 18*c*, so as to permit ready insertion of panel components into the notches 30 of leg 18*b*** in the manner hereinafter described.

The stringer member 20 (FIG. 5), mounted on the edge 14 of the eave 12, is an angle member having a depending leg **20*a* and a web or leg 20*b* extending from the upper margin of the leg at right angles thereto. Leg 20*a* is identical to the leg 18*b* of the trim stringer member 18, and has spaced along its length a plurality of notches 32 and 32' identical in shape and disposition to the notches 30 and 30' of the leg 18*b*. The notches 32 (or, alternatively, the notches 32') snap-fittingly receive and retain the flanges of all the panel components disposed at the end of the array of panels facing away from the wall 11. Member 20 (so oriented that the leg 20*a* is on the side of web 20*b* closest to wall 11) is secured to the eave edge 14 with the web 20*b* lying flat against the under surface of the eave edge or fascia board 16, and with the notches 32 and 32' in register with the corresponding notches 30 and 30' of leg 18*b* of member 18 such that each panel 21, having the component flanges adjacent its opposite ends respectively received in the notches of the legs 18*b* and 20*a*, is axially perpendicular to the wall 11. The plane in which the ends of the components engaged by the stringer member 20 are aligned is intermediate the leg 20*b* and the vertical plane containing the outwardly facing surface of the fascia board 16; an L-section sheet aluminum trim strip 34 (FIG. 1) may be mounted on the fascia board with its long leg 34***a* lying flat against the fascia board outer surface and its short leg 34*b* projecting toward the wall 11, beneath the fascia board, so as to underlie and cover the last-mentioned ends of the panel components engaged by the stringer member 20.

Figures 6, 7, 8, 9:
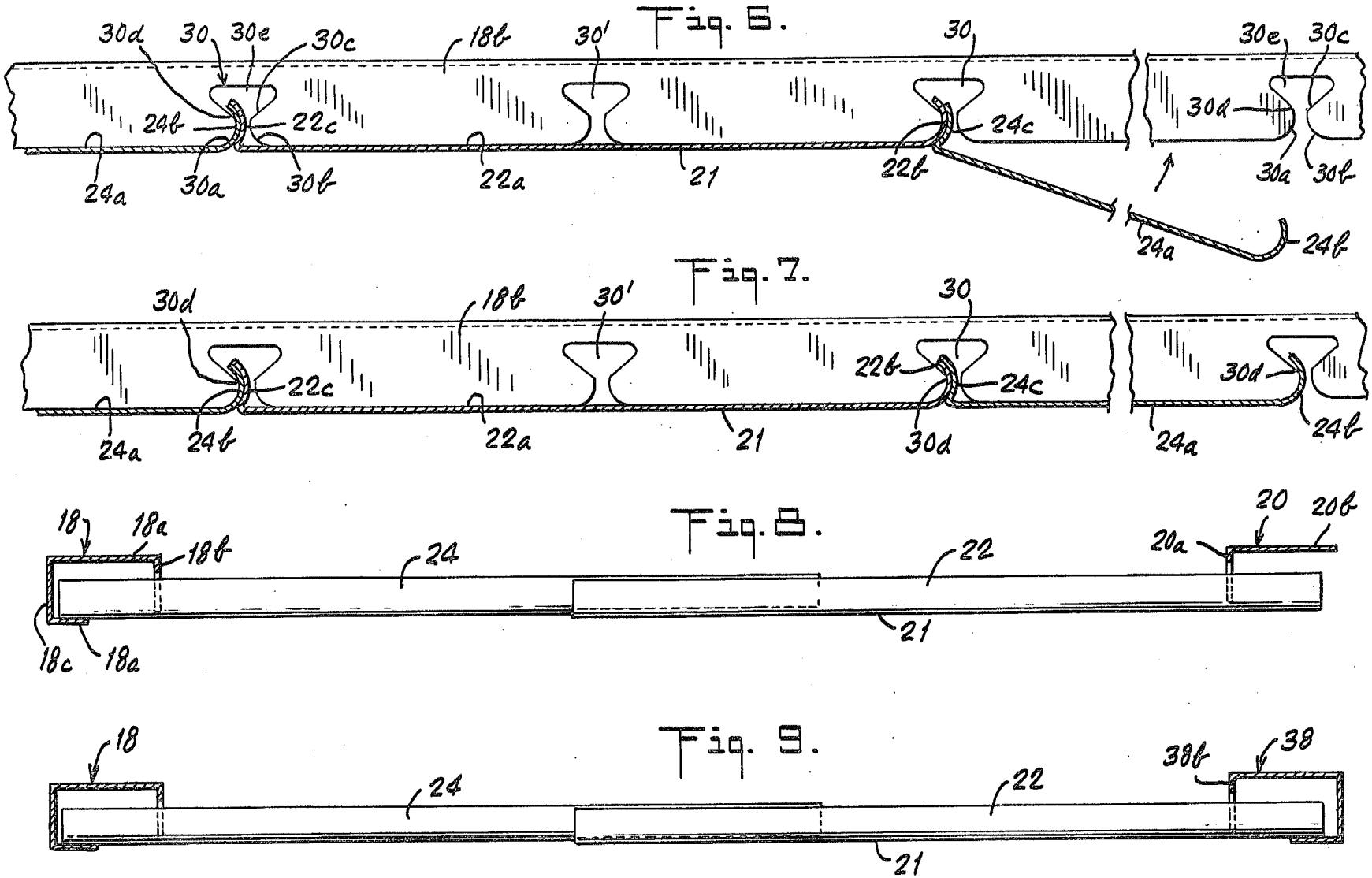
FIG. 6 is an elevational view, partly in section, along the line of engagement of one of the stringer members with panels of the FIG. 1 system, illustrating the manner of installation of the panel components on the stringers.
FIG. 7 is a view similar to FIG. 6, illustrating the disposition of the panel components in relation to the stringer member after the panels are installed.
FIG. 8 is a sectional view taken along the line 8—8 of FIG. 1.
FIG. 9 is a view, similar to FIG. 8, showing a modified embodiment of the invention.

As shown in FIG. 9, in one modification of the system of FIG. 1, the stringer member 20 and trim strip 34 may be replaced by a trim stringer member 38, identical to the member 18 but so oriented that its notched leg 38*b* (identical to the notched leg 18*b*) is on the side of member 38 facing the wall 11. This trim stringer member 38, mounted on the eave edge 14 with its leg 38*b* in the same location as the leg 20*a* of the member 20 in the FIG. 1 system, serves both to hold the ends of the panels located beneath the eave edge and to cover those panel ends. It will be appreciated, of course, that if desired the stringer member mounted on the wall 11 may be a member 20 having no trim portion; i.e. either or both stringer members may be of the type shown at 18 and 38 or of the type shown at 20, and also, when a member 20 is used on the eave, the trim member 34 may be omitted.

While the trim stringer members 18 and 38 and the stringer member 20 have been described above as unitary members, it will be understood that in long installations, successive lengths of such members may be mounted end to end (with maintained uniformity of spacing between notches throughout their combined extent), and as thus mounted, the successive lengths are in effect single continuous members.

The manner of installation of the described soffit system may now be readily understood. With a system of the type shown in FIG. 9, the trim stringer members 18 and 28 are first mounted on the wall 11 and eave edge 14 respectively. The first pair of panel components 22 and 24 are next placed respectively into the two stringer legs 18*b* and 38*b* (one on the wall side, one on the eave side), one after the other, and the two components (positioned to provide the proper amount of overlap for the desired overall length of the panel) are snapped together in the region where they overlap. This procedure is then repeated successively for each following panel along the length of the stringer members until the assembly is complete. Each panel component is placed into its associated notched stringer leg by initially holding the component in a vertical position with the externally concave flange 22*c* or 24*c* uppermost (and with the component axis perpendicular to the stringer), positioning the latter flange in one of the stringer leg notches, and rotating the component upwardly as shown in FIG. 6 (thereby rotating the leg 22*c* or 24*c* into the last-mentioned notches) until the web of the component is horizontal and its outwardly convex flange 22*b* or 24*b* snaps over the point 30*d* of another notch.

Alternatively, when a stringer member of the type shown in FIGS. 1 and 5 is used at the eave edge, each pair of components may be preassembled on the ground to constitute a panel of the desired length, and then placed simultaneously in the two stringer legs 18*b* and 20*a* (in the same upward rotating manner as described above for placing a single component in one stringer leg), again with successive installation of the successive panels along the length of the stringers. The trim strip 34 is mounted on the fascia board, in this case, only after all the panels are in place.

In the completed soffit, each panel 21 is supported only adjacent its extremities, viz. by the snap-fitting interengagement of the ends of the non-overlapped portions of its components respectively with the notched stringer members at the wall and the eave ends, so that each component of the panel is held by a stringer only at one end; yet the snap-fitting interengagement of the overlapped portions of the two components, together with the nesting engagement of the flanges of adjacent panels, maintains the array of panels stable and secure against separation or displacement by wind or other forces.

A particular advantage of the system is that the provision of adjustable-length panels constituted of overlapped pairs of components, rather than single integral panels of fixed length spanning the entire eave overhang, accommodates a range of eave overhangs and thereby avoids the need to cut panels to size for each installation. In other words, panel components of a single standard precut length may be thus assembled (without any cutting by the installer) to provide any of a range of soffit dimensions.

Further advantages, again particularly with respect to ease of installation, inhere in the provision of prenotched stringers to mount the panels. These stringers obviate use of nails or other fasteners to secure the panels, thus greatly simplifying and expediting assembly; and they automatically position the panels at right angles to the wall as the panels are snapped in place, so there is no need for aligning the panels individually. The provision of a combined trim and stringer member reduces the number of different elements required to be installed and inherently achieves proper relative disposition of the stringer, panel and edge-covering trim. As already noted, the configuration of the components and stringer notches makes the snap-fitting assembly operations easy to perform and assures attainment of desired stability of the assembled structure.

It is to be understood that the invention is not limited to the features and embodiments hereinabove specifically set forth, but may be carried out in other ways without departure from its spirit.

We claim:

1. A soffit system comprising (a) a plurality of panels of individually adjustable length disposed in side-by-side parallel array and (b) means for supporting the array of panels, (c) each of said panels comprising at least first and second panel components arranged in tandem with one end portion of one of said first and second components inserted within one end portion of the other such that the last-mentioned end portions of the first and second components overlap, the extent of overlap thereof being adjustable for adjusting the panel length, (d) each of said components being made of resiliently deformable sheet material and having a planar horizontal web and opposite sides bent upwardly to form two parallel longitudinal flanges both having conformingly curved profiles of C-shaped continuous curvature oriented in the same direction such that one of said two flanges is externally convex and the other is externally concave, the first and second components of each panel having the same orientation, and the flanges of said one end portion of said one component being nestingly gripped between the flanges of said one end portion of said other component for enabling their last-mentioned end portions to be secured together at any relative position of the two components within a range of extents of overlap of the components corresponding to a range of lengths of the panel they comprise, (e) said first and second components of each panel having substantially identical cross-sectional dimensions, the flanges of said first and second components all having substantially identical radii of cross-sectional curvature, and the externally convex flange of each of said components being smoothly continuous with the planar web thereof, such that one end portion of either of said first and second components is snap-fittingly insertable into one end portion of the other of said first and second components.

2. A system as defined in claim 1, wherein (i) the first components of all the panels are located at one end of the array, and (ii) said supporting means comprises first mounting means extending transversely of said first components and snap-fittingly engageable by the flanges of said first components, at a first locality spaced from said second components, (iii) said supporting means further comprising second mounting means for supporting said panels at a second locality spaced from said first components, and (iv) each of said panels being supported only at said first and second localities such that the central portion of the panel, including the entirety of the overlapping end portions of its components, is suspended therebetween.

3. A system as defined in claim 2, wherein said second mounting means comprises means extending transversely of said second components and snap-fittingly engageable by the flanges of said second components.

4. A system as defined in claim 3, wherein (i) the first and second components of all the panels of the array have the same orientation and (ii) the externally convex flanges of the components of each panel in the array are nestingly received within the externally concave flanges of the components of the next adjacent panel in the array.

5. A system as defined in claim 4, wherein each of said first and second mounting means comprises a horizontally elongated stringer disposed above and extending transversely across said array and having spaced along its length a plurality of downwardly opening notches, each dimensioned to receive two nested component flanges, such that the opposite longitudinal flanges of each component are snap-fittingly received in two notches of one of the stringers.

6. A system as defined in claim 5, wherein both the first and second components of all the panels in the array are substantially identical to each other in all dimensions, each of said components being a unitary formed sheet metal member.

7. A soffit system as defined in claim 6, wherein the webs of at least some of said components have plural ventilating openings.

8. A system as defined in claim 4, wherein at least one of said stringers comprises a metal channel member having first and second spaced parallel depending legs, the notches of the stringer being formed in said first leg, the ends of the components engaged by the stringer being located intermediate said legs, and said second leg having its lower extremity bent into a return flange for underlying and thereby covering the last-mentioned component ends.

9. An adjustable length soffit panel comprising (a) at least first and second panel components arranged in tandem with one end portion of one of said first and second components inserted within one end portion of the other such that the last-mentioned end portions of the first and second components overlap, the extent of overlap thereof being adjustable for adjusting the panel length, (b) each of said components being made of resiliently deformable sheet material and having a planar horizontal web and opposite sides bent upwardly to form two parallel longitudinal flanges both having conformingly curved profiles of substantially identical, C-shaped continuous curvature oriented in the same direction such that one of said two flanges is externally convex and the other is externally concave, (c) the first and second components of the panel having the same orientation and being substantially identical to each other in cross-sectional dimensions, (d) the flanges of said one end portion of said one component being nestingly gripped between the flanges of said one end portion of said other component for snap-fittingly securing their last-mentioned end portions together throughout a range of extents of overlap of the first and second components corresponding to a range of lengths of the panel, and (e) the externally convex flange of each of said components being smoothly continuous with the planar web thereof.

10. A soffit system comprising (a) a plurality of panels of individually adjustable length disposed in side-by-side parallel array and (b) means for supporting the array of panels, (c) each of said panels comprising first and second resiliently deformable panel components arranged in tandem with one end portion of one of said first and second components snap-fittingly inserted within one end portion of the other such that the last-mentioned end portions of the first and second components overlap, the extent of overlap thereof being adjustable for adjusting the length of the panel;

(d) said supporting means engaging each of said panels only at locations adjacent the opposite extremities of the panel remote from said overlapping end portions of the components of the panel such that the central portion of each panel, including the entirety of said overlapping end portions of the components thereof, is suspended between said locations.

11. A system as defined in claim 10, mounted on a building having a vertical exterior wall and a horizontally extending eave spaced outwardly of the wall in parallel relation thereto, wherein said supporting means comprises first and second support elements respectively secured to said wall and said eave, and wherein each of said panels extends from said wall to said eave, each of said panels being engaged adjacent one extremity by said first support element and adjacent the other extremity by said second support element.

* * * * *